US005388283A

United States Patent [19]

Garnett

[11] Patent Number: 5,388,283

[45] Date of Patent: Feb. 14, 1995

[54] FLOATING THERMAL POOL COVER RETAINING DEVICE AND METHOD THEREFOR

[76] Inventor: Terry L. Garnett, 12694 E. Cortez Dr., Scottsdale, Ariz. 85259

[21] Appl. No.: 28,082

[22] Filed: Mar. 8, 1993

[51] Int. Cl.[6] ..... E04H 4/14

[52] U.S. Cl. ..... 4/503; 24/563

[58] Field of Search ..... 4/503, 504, 498; 24/457, 543, 563

[56] References Cited

U.S. PATENT DOCUMENTS

| | | | |
|---|---|---|---|
| 2,260,584 | 10/1941 | Schuck et al. | 24/457 X |
| 2,751,653 | 6/1956 | Leibow | 24/563 X |
| 2,870,454 | 1/1959 | Schippert et al. | 4/503 |
| 3,959,854 | 6/1976 | Lewis | 24/563 X |
| 4,692,969 | 9/1987 | Johnson | 24/563 X |
| 4,946,065 | 8/1990 | Goulter et al. | 24/563 X |

FOREIGN PATENT DOCUMENTS

| | | | |
|---|---|---|---|
| 2214799 | 9/1989 | United Kingdom | 4/503 |

*Primary Examiner*—Charles E. Phillips
*Attorney, Agent, or Firm*—Harry M. Weiss

[57] ABSTRACT

A combination of a floating thermal pool cover and thermal pool cover retaining device having a flexible clamping portion for clinging to an extended edge of a pool and a retaining portion for maintaining the floating thermal pool cover in direct contact with the water surface area of a pool. By keeping the floating thermal pool cover in contact with the water surface area of the pool, the pool water is heated more quickly and the amount of debris which falls into the pool is minimized.

18 Claims, 2 Drawing Sheets

FLOATING THERMAL POOL COVER RETAINING DEVICE AND METHOD THEREFOR

FIELD OF THE INVENTION

This invention relates generally to pool cover retaining devices and, more specifically, to a floating thermal pool cover retaining device and method therefor which provides a self-securing device that simultaneously grips an extended edge of a pool and holds a portion of a floating thermal pool cover in place. Floating thermal pool cover retaining devices are removably installed at several locations around the perimeter of the pool in order to retain the thermal pool cover in place and to prevent any portion thereof from lifting off of the surface of the pool.

DESCRIPTION OF THE PRIOR ART

Thermal pool covers provide several useful functions in the proper maintenance of a pool. As the name implies, thermal pool covers are designed to transfer and maintain heat in the water. In addition, these devices lessen the amount of dirt and debris that falls into the pool, thereby reducing the quantity of time and money that must be spent in order to preserve the cleanliness of the water. Thermal pool covers that are fabricated from colorful, decorative materials may also be selected in order to compliment the aesthetic quality of a pool patio area. However, in order to take advantage of the possible benefits offered by the use of a thermal pool cover, the entire surface area of a pool should be covered by the thermal pool cover.

In the past, thermal pool covers were extremely limited in their ability to carry out the functions for which they were created. In general, thermal pool covers are layers of floatable material such as plastic which define an inner region filled with gas such as air. Ideally, heat from the sun warms the air constrained within the layers of plastic which in turn slowly transfers its heat to the water in the pool. Even under optimum conditions, it typically takes several days to raise the average temperature of the water in a pool by 5–10 degrees. Of course, there are many factors that influence the rate of heat transfer in this process, but by focusing on the contribution of the thermal pool cover to this process and holding other factors such as weather conditions constant, one will more quickly heat a pool by keeping the entire surface area of the pool covered by the thermal pool cover. This is the case because the heat transfer per unit area of a thermal pool cover is roughly uniform. In other words, there is no portion of a thermal pool cover which warms pool water faster than any other portion of the same thermal pool cover; therefore, it stands to reason that the heat transfer process will occur in a faster, more efficient manner when the entire pool water surface area is covered by the thermal pool cover.

In an effort to provide thermal pool covers that cover the entire water surface area of a pool, the surface area of prior art thermal pool covers was larger than the surface area of the pool. This created a serious problem for these prior art pool covers, namely what to do with the excess material of the pool cover. In most cases, after the water surface area of the pool was covered, the extra pool cover material was draped over the edge of the pool and then weighted down at several points around the perimeter of the pool. However, despite the best intended effort, gusts of wind invariably lift the prior art pool covers along their unweighted portions, and consequently lift substantial parts of the pool cover from the water. As the wind lifts the pool cover and flows across the surface of the pool, the temperature of the pool water tends to drop; furthermore, the wind entrains dirt and other foreign matter that falls into the pool. Obviously then, these actions tend both to slow the desired heat transfer process and raise the amount of time which must be spent to keep the pool clean.

In an attempt to overcome these noteworthy flaws associated with the prior art thermal pool covers, pool covers were cut to conform to the water surface area of the pool. In this instance, no extra pool cover material extends beyond the edge of the pool; nevertheless, this approach also has its problems. Many of today's swimming pools have automatic cleaning systems which direct pressurized jets of water toward dirt which has settled out on pool surface areas in order to stir up the dirt and then filter it out of the water. Oftentimes, the force of the water jets lifts thermal pool covers from the water surface area. As in the previous discussion regarding other prior art pool covers, when the pool cover is raised off of the water, the probability of having debris fall into the pool increases and the thermal pool cover heating process is slowed.

Therefore, a need existed to provide a device that enabled a thermal pool cover to remain in contact with the entire water surface area of the pool, thereby improving the ability of the pool cover to warm the pool water, to keep unwanted debris from the pool, and to improve the overall appearance of the pool area.

SUMMARY OF THE INVENTION

In accordance with one embodiment of this invention, it is an object of this invention to provide an improved floating thermal pool cover and thermal pool cover retaining device.

It is another object of this invention to provide an improved thermal pool cover retaining device having a flexible, self-securing clamping portion for gripping an edge of a pool.

It is a further object of this invention to provide an improved thermal pool cover retaining device having a retaining portion for holding the improved thermal pool cover in place and to prevent any portion thereof from lifting from the surface of the water in a pool.

BRIEF DESCRIPTION OF THE PREFERRED EMBODIMENTS

In accordance with one embodiment of this invention, a combination floating thermal pool cover and thermal pool cover retaining device is disclosed comprising, in combination, a thermal pool cover having a plurality of slits therein for use on a swimming pool, thermal pool cover retaining device for the thermal pool cover comprising, clamping means for removably coupling the retaining device to a portion of an extending edge of the swimming pool, and retaining means integrally connected to the clamping means for insertion through one of the plurality of slits in the floating thermal pool cover to hold the thermal pool cover in place and to prevent any portion of the thermal pool cover from lifting.

In accordance with another embodiment of this invention, a method of providing a combination floating thermal pool cover and thermal pool cover retaining device is provided comprising the steps of providing a thermal pool cover having a plurality of slits therein for use on a swimming pool, providing a thermal pool cover retaining device for the thermal pool cover comprising clamping means for removably coupling the retaining device to a portion of an extending edge of the swimming pool, and retaining means integrally connected to the clamping means for insertion through one of the plurality of slits in the floating thermal pool cover to hold the thermal pool cover in place and to prevent any portion of the thermal pool cover from lifting.

The forgoing and other objects, features, and advantages of the invention will be apparent from the following, more particular, description of the preferred embodiments of the invention, as illustrated in the accompanying drawings.

DESCRIPTION OF THE PREFERRED EMBODIMENT

Figure 1:
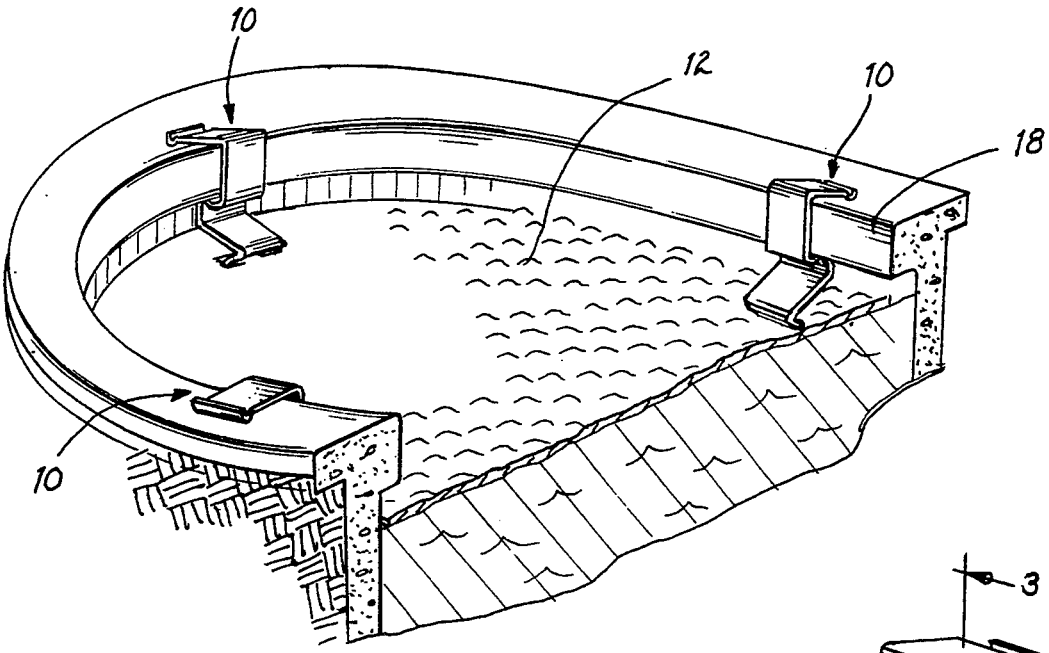
FIG. 1 is a perspective drawing showing three pool cover retaining devices securing a floating thermal pool cover.

Referring to FIG. 1, a thermal pool cover retaining device is generally designated by reference number 10. A portion of a floating thermal pool cover 12 is kept in contact with the water surface area of a pool by three pool cover retaining devices 10 which are attached along the edge 18 of the pool.

Figure 2:
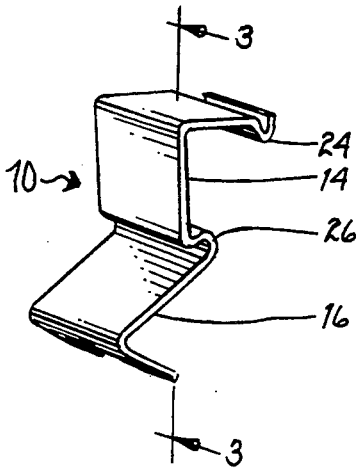
FIG. 2 is an elevational view showing one thermal pool cover retaining device.

Referring to FIG. 2, a single pool retaining device 10 is shown having a clamping portion 14 for holding the device 10 to the edge 18 of the pool and a retaining portion 16 for insertion through the thermal pool cover 12. The clamping portion 14 has a J-shaped bend configuration 24 and an S-shaped bend configuration 26 both of which form areas for contact with the pool edge 18.

Figure 3:
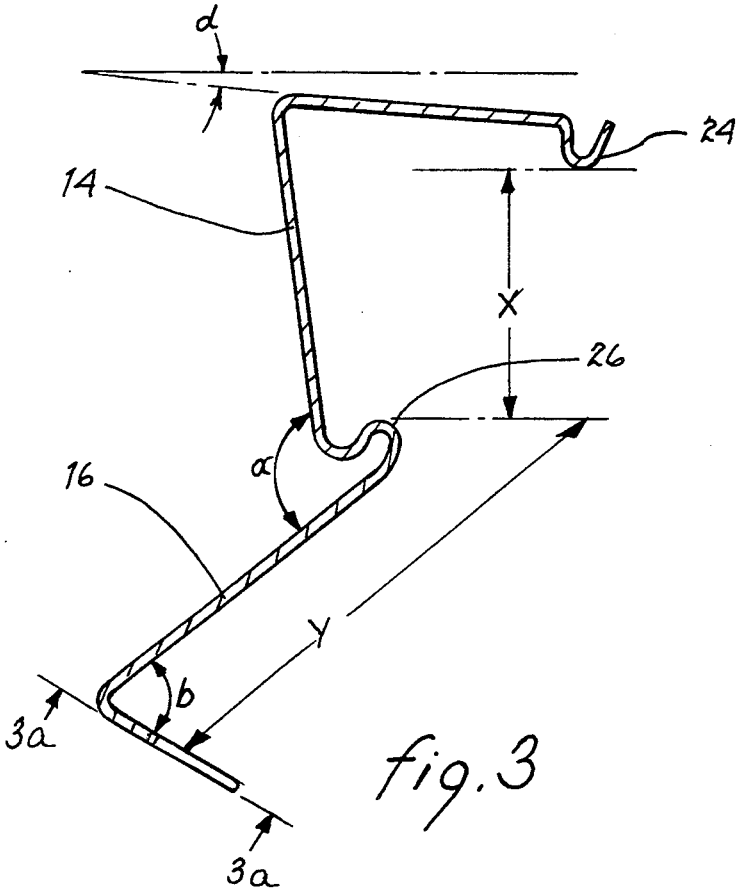
FIG. 3 is a cross sectional view of the thermal pool cover retaining device taken along line 3—3 of FIG. 2.

Referring to the cross-sectional view of FIG. 3, the J-shaped bend configuration 24 is formed at the end of a first member which has been pre-stressed to form an angle "d" with the horizontal line. A second member is integrally connected to the first member. This second member has at one of its ends the S-shaped bend configuration 26. The distance between the horizontal tangent to both the J-shaped and the S-shaped bend configurations 24 and 26 is defined as "x" which corresponds to thickness of a pool edge 18. Since the clamping portion 14 is pre-stressed and because it is made of flexible materials, it firmly clamps pool edges 18 of different thickness "x". The "a" defines an angle between the clamping and retaining portions 14 and 16 respectively of the device 10. In addition, "b" defines an angle between two members of the retaining portion 16. The pre-stressed bends which form the angles "a" and "b" help to keep the retaining portion 16, and correspondingly, the thermal pool cover 12 in contact with the water. The "y" dimension of the retaining portion 16 may be manufactured of different length depending upon the distance from a lower portion of a pool edge 18 to the thermal pool cover 12.

Figure 3A:
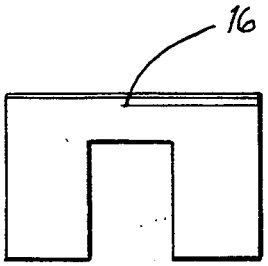
FIG. 3*a* is a front view showing the retaining portion of the thermal pool cover retaining device taken along line 3*a*—3*a* of FIG. 3.

Referring to FIG. 3*a*, a notch is cut into the retaining portion 16 to form extending members. These members are for insertion into slots cut along the perimeter of the thermal pool cover 12 in order to hold the thermal pool cover 12 in contact with the water of the pool.

Figure 4:
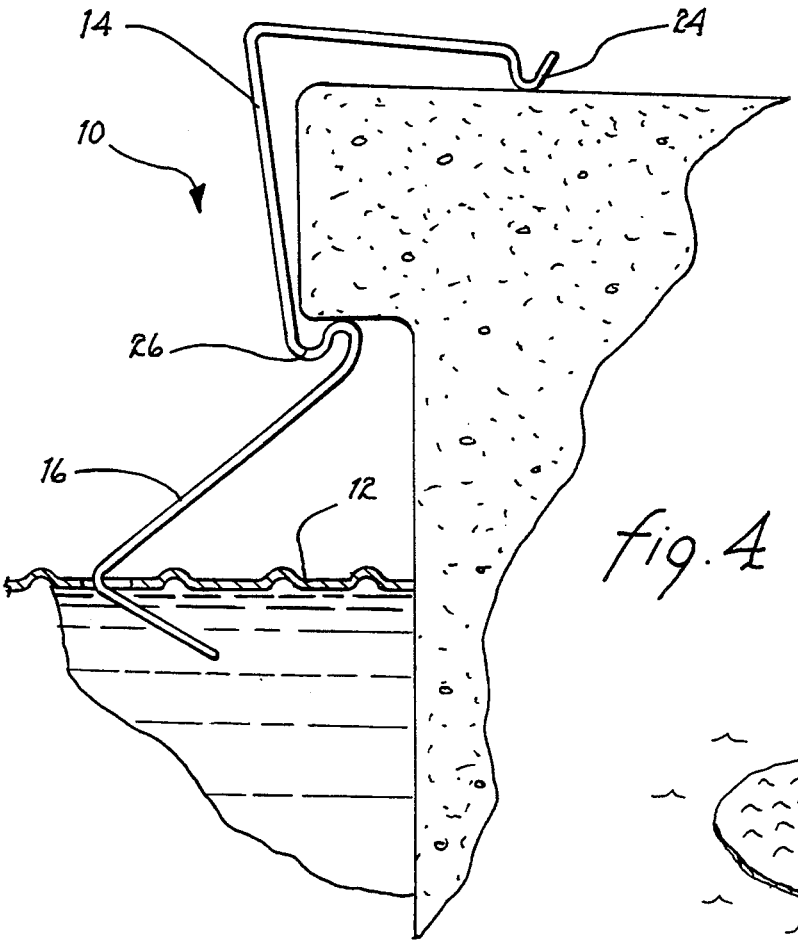
FIG. 4 is a side view of the thermal pool cover retaining device showing the clamping portion affixed to an edge of a pool and displaying the retaining portion fastened to a floating thermal pool cover.

Referring to FIG. 4, a portion of both the J-shaped bend configuration 24 and S-shaped bend configuration 26 contacts a surface of pool edge 18 to fasten the clamping portion 14 of the device 10 to the pool edge 18. Simultaneously, the retaining portion 16 holds the thermal pool cover 12 in contact with the water of the pool.

Figure 4A:
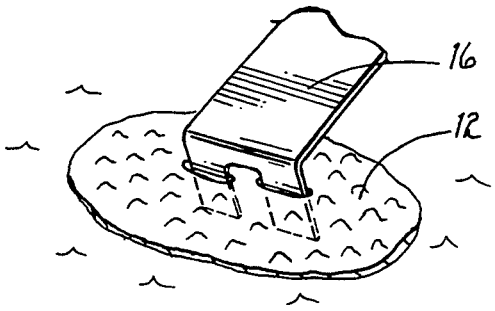
FIG. 4*a* is an elevational view showing the retaining portion of the thermal pool cover retaining device as it passes through a plurality of slits in a portion of a floating thermal pool cover.

Referring to FIG. 4*a*, a closer view of the retaining portion 16 shows how it is fit into a portion of the thermal pool cover 12.

Figure 5:
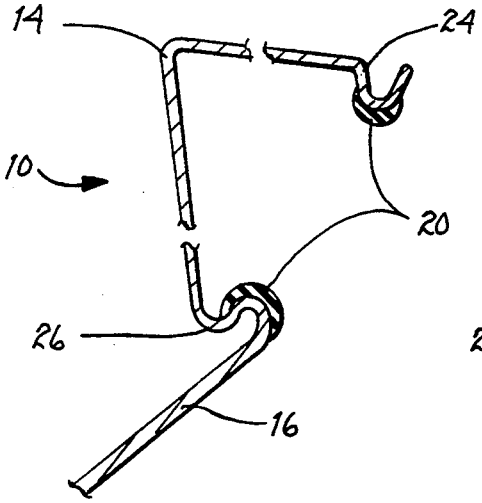
FIG. 5 is a side view of the thermal pool cover retaining device showing rubber gripping material on the areas of the clamping portion that contact a surface of a pool's edge.
Figure 6:
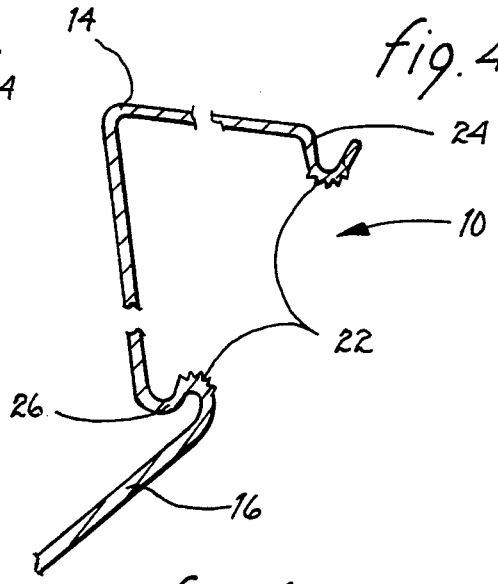
FIG. 6 is a side view of the thermal pool cover retaining device showing serrated gripping edges on the areas of the clamping portion that contact a surface of a pool's edge.

Referring to FIGS. 5 and 6, rubber coating 20 and serrated edges 22, respectively, are located on a surface of both the J-shaped and the S-shaped bend configurations 24 and 26 to improve the holding strength of the clamping portion 14 of the pool cover retaining device 10.

OPERATION

The floating thermal pool cover 12 is first spread out over the surface area of the pool. The retaining portion 16 of each of the pool cover retaining devices is then easily inserted through the slits located along the perimeter of the thermal pool cover 12. With the retaining portion 16 installed, the J-shaped 24 and S-shaped 26 bend configurations are pulled slightly apart from one another in order to allow the clamping portion 14 to fit easily over the pool edge 18. The above operation is repeated until all the retaining devices 10 have been installed, thereby providing a system which will keep the floating thermal pool cover 12 in contact with the entire water surface area of the pool.

While the invention has been particularly shown and described with reference to the preferred embodiments thereof, it will be understood by those skilled in the art that the foregoing and other charges in form and details may be made therein without departing from the spirit and scope of the invention. For example, the retaining device 10 can be constructed from any of a number of flexible, buoyant materials such as plastic, fiberglass, or composite material. Although the retaining device 10 is designed to fit the different dimensions and configurations of most pools, the dimensions of the device 10 can be changed in order to conform to unusual pool dimensions and configurations without departing from the scope of the original thermal pool cover retaining device 10. In addition, it would be obvious to one skilled in the art to improve the holding strength of the thermal pool cover retaining device 10 by forming indentations into the surface of the pool edge 18 which correspond to a contact portion of the J-shaped 24 and S-shaped 26 bend configurations of the device 10.

I claim:

1. A combination floating thermal pool cover and thermal pool cover retaining device comprising, in combination:

a thermal pool cover having a plurality of slits therein for use on a swimming pool;

a thermal pool cover retaining device for said thermal pool cover comprising:

clamping means for removably coupling said retaining device to a substantially flat surface portion of an extending edge of the swimming pool; and retaining means integrally connected to said clamping means for insertion through one of said plurality of slits in said floating thermal pool cover to hold said thermal pool cover in place and to prevent any portion of said thermal pool cover from lifting;

said clamping means further comprising a first member having a substantially J-shaped bend configuration and having a portion thereof for contact with a substantially flat upper surface of said edge and a second member integrally connected to said first member and having a substantially S-shaped bend configuration and having a portion thereof for contact with a substantially flat bottom surface of said pool edge.

2. The device of claim 1 wherein said retaining means having a notch therein and having a plurality of extended members defined by said notch, each of said extended members having a configuration for insertion through said plurality of slits in said floating thermal pool cover to hold said thermal pool cover in place and to prevent any portion of said thermal pool cover from lifting.

3. The device of claim 1 wherein said clamping means is pre-stressed such that said portion of said substantially J-shaped bend configuration provides a force against said substantially flat upper surface of said edge and said portion of said substantially S-shaped bend configuration provides a force against said substantially flat bottom surface of said edge in order to secure said clamping means to both said substantially flat upper and substantially flat bottom surfaces of said edge.

4. The device of claim 3 wherein a surface portion of both said substantially J-shaped and S-shaped bend configurations have gripping means located thereon for providing an improved grip on both said substantially flat upper and substantially flat bottom surfaces of said edge.

5. The device of claim 4 wherein said gripping means is a rubber coating.

6. The device of claim 4 wherein said gripping means is a serrated surface portion.

7. The device of claim 1 wherein said retaining device is fabricated from a substantially flexible material.

8. The device of claim 7 wherein said retaining device is made of a material which is buoyant in water.

9. The device of claim 8 wherein said retaining device is of a color and pattern compatible with a color and pattern of said thermal pool cover.

10. A method of providing a combination floating thermal pool cover and thermal pool cover retaining device comprising the steps of:

covering a swimming pool water surface with a thermal pool cover having a plurality of slits therein;

retaining said thermal pool cover with a thermal pool cover retaining device for said thermal pool cover comprising:

clamping means for removably coupling said retaining device to a substantially flat surface portion of an extending edge of the swimming pool; and retaining means integrally connected to said clamping means for insertion through one of said plurality of slits in said floating thermal pool cover to hold said thermal pool cover in place and to prevent any portion of said thermal pool cover from lifting;

said clamping means further comprising a first member having a substantially J-shaped bend configuration and having a portion thereof for contact with a substantially flat upper surface of said edge and a second member integrally connected to said first member and having a substantially S-shaped bend configuration and having a portion thereof for contact with a substantially flat bottom surface of said pool edge.

11. The method of claim 10 wherein said clamping means is pre-stressed such that said portion of said substantially J-shaped bend configuration provides a force against said substantially flat upper surface of said edge and said portion of said substantially S-shaped bend configuration provides a force against said substantially flat bottom surface of said edge in order to secure said clamping means to both said substantially flat upper and substantially flat bottom surfaces of said edge.

12. The method of claim 11 wherein a surface portion of both said substantially J-shaped and S-shaped bend configurations have gripping means located thereon for providing an improved grip on both said substantially flat upper and substantially flat bottom surfaces of said edge.

13. The method of claim 12 wherein said gripping means is a rubber coating.

14. The method of claim 12 wherein said gripping means is a serrated surface portion.

15. The method of claim 10 wherein said retaining means having a notch therein and having a plurality of extended members defined by said notch, each of said extended members having a configuration for insertion through said plurality of slits in said floating thermal pool cover to hold said thermal pool cover in place and to prevent any portion of said thermal pool cover from lifting.

16. The method of claim 10 wherein said retaining device is fabricated from a substantially flexible material.

17. The method of claim 16 where in said retaining device is made of a material which is buoyant in water.

18. The method of claim 17 wherein said retaining device is of a color and pattern compatible with a color and pattern of said thermal pool cover.

* * * * *